US007493956B2

(12) United States Patent
Shaw et al.

(10) Patent No.: US 7,493,956 B2
(45) Date of Patent: Feb. 24, 2009

(54) SUBSURFACE SAFETY VALVE WITH CLOSURE PROVIDED BY THE FLOWING MEDIUM

(75) Inventors: Brian S. Shaw, Broken Arrow, OK (US); Ryan J. Morgan, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 105 days.

(21) Appl. No.: 11/376,940

(22) Filed: Mar. 16, 2006

(65) Prior Publication Data

US 2007/0215352 A1 Sep. 20, 2007

(51) Int. Cl.
*E21B 33/13* (2006.01)
*E21B 33/134* (2006.01)

(52) U.S. Cl. ..... 166/292; 166/300; 166/386; 166/192

(58) Field of Classification Search ..... 166/163, 166/110, 169, 192, 319, 386, 292, 294, 295, 166/300
See application file for complete search history.

(56) References Cited

U.S. PATENT DOCUMENTS

| | | | | | |
|---|---|---|---|---|---|
| 2,609,880 | A * | 9/1952 | Dyer | 166/117 |
| 3,139,931 | A * | 7/1964 | Simpson et al. | 166/63 |
| 3,614,988 | A * | 10/1971 | Moore | 166/193 |
| 3,709,296 | A * | 1/1973 | Glenn, Jr. | 166/253.1 |
| 4,083,406 | A * | 4/1978 | Metz | 166/286 |
| 4,119,150 | A * | 10/1978 | Froelich | 166/276 |
| 4,276,934 | A * | 7/1981 | Fraser | 166/286 |
| 4,674,570 | A * | 6/1987 | Jackson | 166/187 |
| 4,730,675 | A * | 3/1988 | Wygant et al. | 166/295 |
| 4,741,396 | A * | 5/1988 | Falxa | 166/169 |
| 4,972,906 | A * | 11/1990 | McDaniel | 166/276 |
| 5,146,985 | A * | 9/1992 | Alquie et al. | 166/270 |
| 5,307,984 | A * | 5/1994 | Nagaoka et al. | 228/189 |
| 5,358,043 | A | 10/1994 | Moradi-Araghi | 166/270 |
| 5,358,050 | A * | 10/1994 | Schmidt | 166/294 |
| 5,897,095 | A * | 4/1999 | Hickey | 251/57 |
| 6,026,903 | A | 2/2000 | Shy | 166/292 |
| 6,196,315 | B1 * | 3/2001 | Surles et al. | 166/293 |
| 6,478,088 | B1 * | 11/2002 | Hansen et al. | 166/285 |
| 6,488,089 | B1 * | 12/2002 | Bour et al. | 166/292 |
| 6,818,598 | B2 * | 11/2004 | Maberry et al. | 507/216 |
| 6,910,537 | B2 * | 6/2005 | Brown et al. | 166/294 |
| 6,991,048 | B2 * | 1/2006 | Zupanick | 175/61 |

(Continued)

FOREIGN PATENT DOCUMENTS

EP 0722037 A2 7/1996

(Continued)

*Primary Examiner*—Shane Bomar
(74) *Attorney, Agent, or Firm*—Shawn Hunter

(57) ABSTRACT

Devices and methods for selectively closing and opening flow of production fluid (oil, gas, or water) through the flowbore of a production string by chemically altering the phase of fluid media flowing through the production tubing to form a substantially solid plug or blockage. The phase of the fluid media is altered by selectively injecting a predetermined catalyst into a portion of the flowbore wherein it is desired to create a plug or blockage. When it is desired to remove the blockage, a dissolving agent is selectively added to the flowbore via a reversing sub to reverse the phase of the blockage from solid to liquid/gas. As the blockage is dissolved, flow is reestablished within the flowbore.

20 Claims, 4 Drawing Sheets

U.S. PATENT DOCUMENTS

| | | | | |
|---|---|---|---|---|
| 7,303,014 | B2 * | 12/2007 | Reddy et al. | 166/293 |
| 2004/0007390 | A1 * | 1/2004 | Zupanick | 175/61 |
| 2004/0262003 | A1 * | 12/2004 | Nguyen | 166/295 |
| 2006/0144591 | A1 * | 7/2006 | Gonzalez et al. | 166/277 |

FOREIGN PATENT DOCUMENTS

| | | | |
|---|---|---|---|
| WO | WO 2005/045183 | A1 | 5/2005 |

* cited by examiner

SUBSURFACE SAFETY VALVE WITH CLOSURE PROVIDED BY THE FLOWING MEDIUM

BACKGROUND OF THE INVENTION

1. Field of the Invention

The invention relates generally to mechanisms and methods for closing off a subsurface wellbore and, in particular aspects, to surface-controlled subsurface safety valves used within wellbores.

2. Description of the Related Art

Surface-controlled subsurface safety valves (SSSVs) are used to selectively close off lower portions of the flowbore of a production tubing string in the event of an emergency. These valves can then be reopened later when the emergency situation has been remedied and it is desired to reestablish flow through the flowbore. Common SSSV's are flapper-type valves that are biased closed by a spring mechanism and then reopened, under surface control, by an axially moveable flow tube. Although flapper valves have been in use for a long period of time, they continue to suffer from problems that prevent them from being an ideal solution in all situations. Because they are mechanical devices, their components are prone to damage during typical operation. Also, the flow path might become encrusted with scales or hydrates during production, which can cause the valve to become stuck in an open, closed, or partially open position.

Certain devices are known that utilize plugs that will block fluid flow through the flowbore and can be readily destroyed when needed. U.S. Pat. No. 6,026,903 issued to Shy et al., for example, discloses a frangible disappearing plug that can be ruptured and destroyed to reopen the flowbore of the well. However, this type of structure must be run into the well at the outset in order to be useful as a plug. This makes it unsuitable for use as an SSSV, since it could not be used to rapidly close off a lower portion of the flowbore in an emergency.

There is a need for an alternative to standard flapper-type surface controlled safety valves. There is a need for an alternative technique that can be used to establish a blockage within the flowbore of a well during operation in a substantially rapid manner under surface control to close a portion of the flowbore in the event of an emergency. This technique should also allow the flowbore to be reopened, if desired.

The present invention addresses the problems of the prior art.

SUMMARY OF THE INVENTION

The invention provides devices and methods for selectively closing and opening flow of production fluid (oil, gas, or water) through the flowbore of a production string by chemically altering the phase of fluid media flowing through the production tubing to form a substantially solid plug or blockage. In a preferred embodiment, the phase of the fluid media is altered by selectively injecting a predetermined catalyst into a portion of the flowbore wherein it is desired to create a plug or blockage. The composition of the catalyst will vary depending upon the type of media (oil, gas, water) that is flowing through the tubing. The blockage will typically form in a period of time that is short enough to essentially close off flow under emergency conditions.

When it is desired to remove the blockage, a dissolving agent is selectively added to the flowbore via a reversing sub to reverse the phase of the blockage from solid to liquid/gas. As the blockage is dissolved, flow is reestablished within the flowbore.

DETAILED DESCRIPTION OF THE PREFERRED EMBODIMENTS

Figure 1:
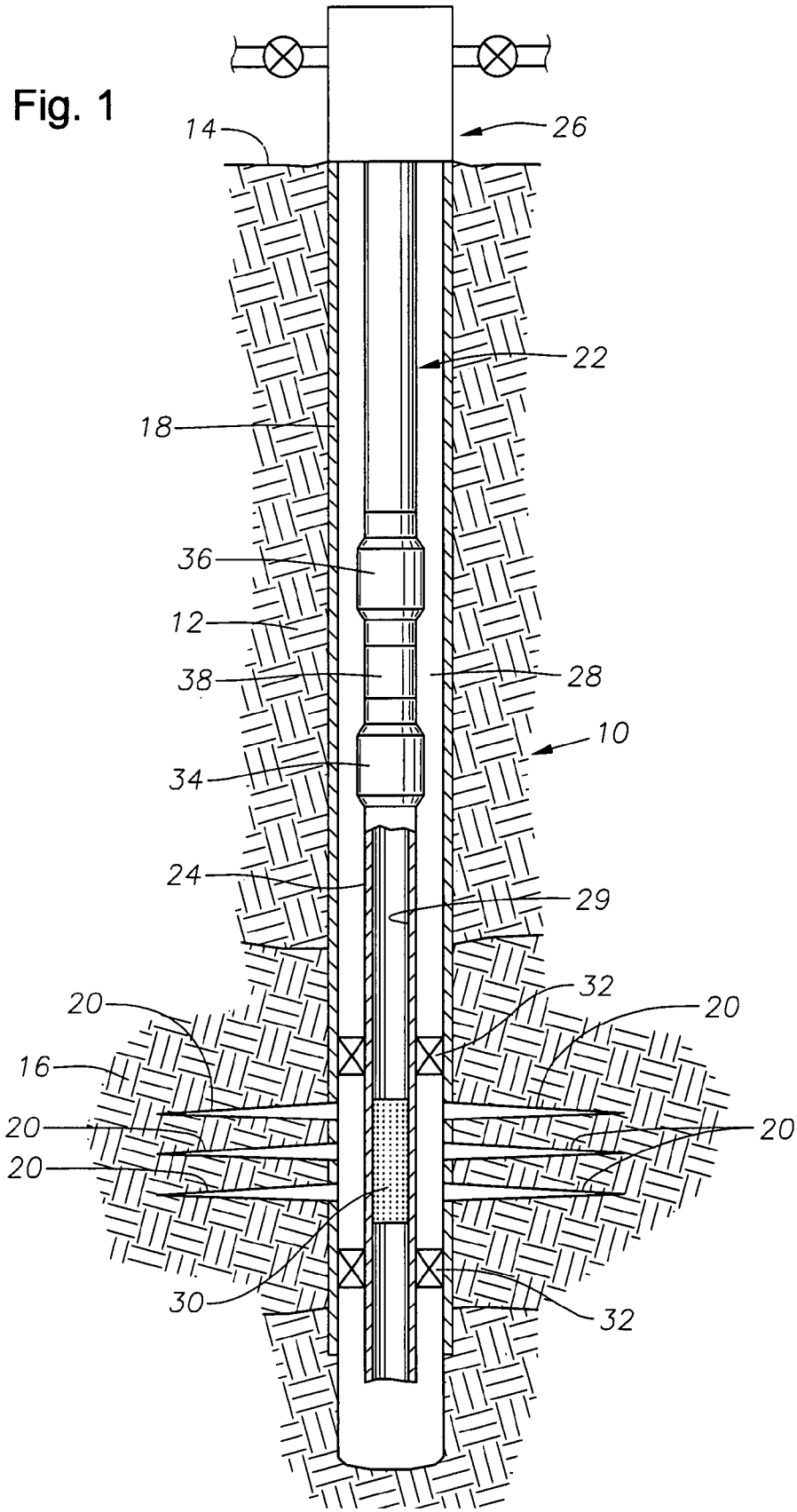
FIG. 1 is a side, cross-sectional view of an exemplary wellbore containing a production tubing string that incorporates a subsurface safety valve constructed in accordance with the present invention.

FIG. 1 schematically depicts an exemplary wellbore 10 that has been drilled into the earth 12 from the surface 14 to a subterranean formation 16. The formation 16 contains a volume of production fluid which may be a mixture of oil, water, and/or gas. The wellbore 10 has been cased with steel casing 18, in a manner known in the art. Perforations 20 allow fluid communication from the formation 16 into the wellbore 10.

An exemplary production assembly 22 is shown that includes a production tubing string 24 that extends downwardly from a wellhead 26 through the wellbore 10. An annulus 28 is defined between the outer radial surface of the tubing string 24 and the casing 18. An axial flowbore 29 is defined within the tubing string 24. A production nipple 30 incorporated into the tubing string 24 is located adjacent the perforations 20. Packers 32 are set on each axial side of the production nipple 30. A surface controlled subsurface safety valve (SSSV) 34 is also incorporated into the production assembly 22 above the production nipple 30. Also incorporated into the production assembly 22 is a reversing sub 36 and a plug formation sub 38, the structure and function of which will be described in detail shortly.

Figure 2:
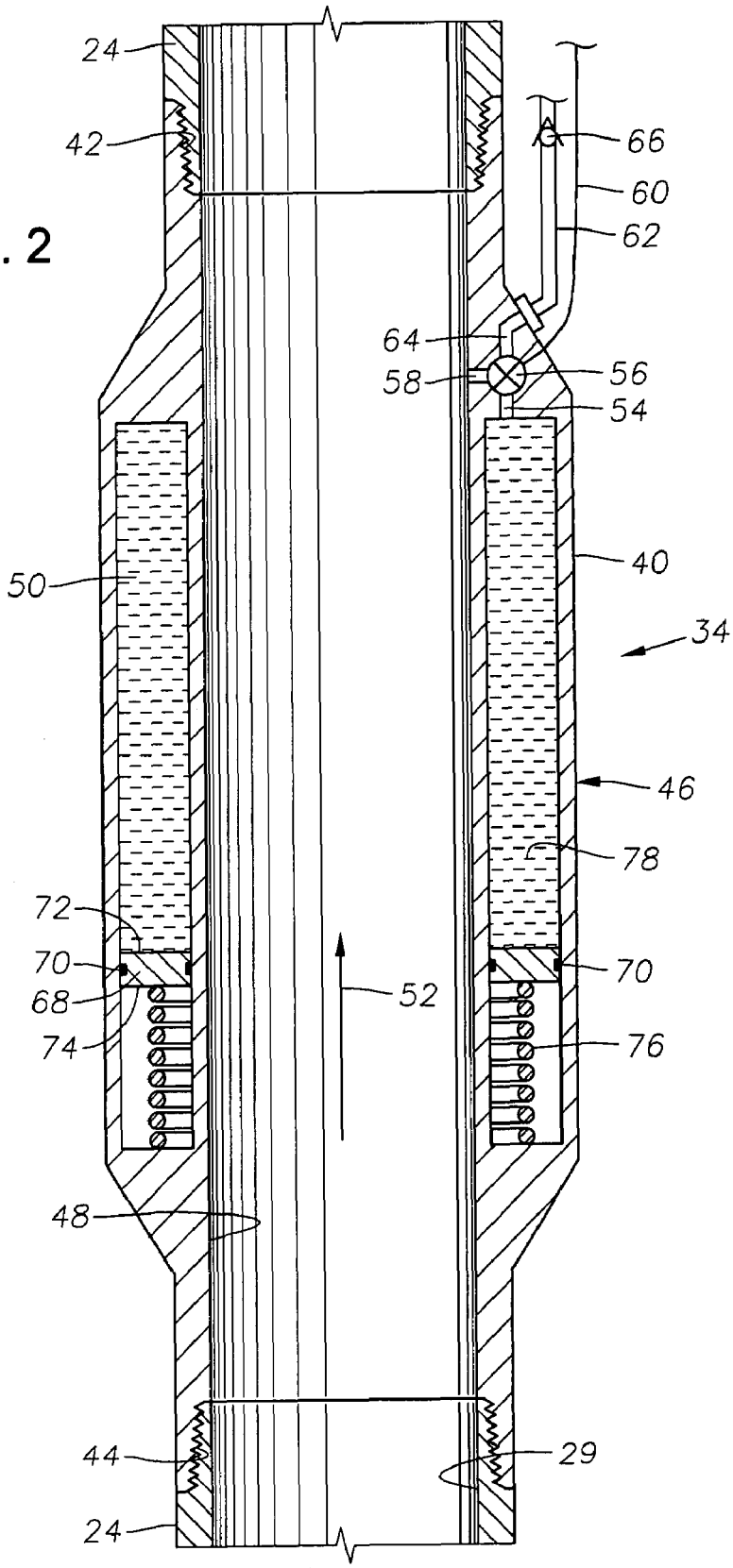
FIG. 2 is a side, cross-sectional view of an exemplary SSSV constructed in accordance with the present invention.
Figure 3:
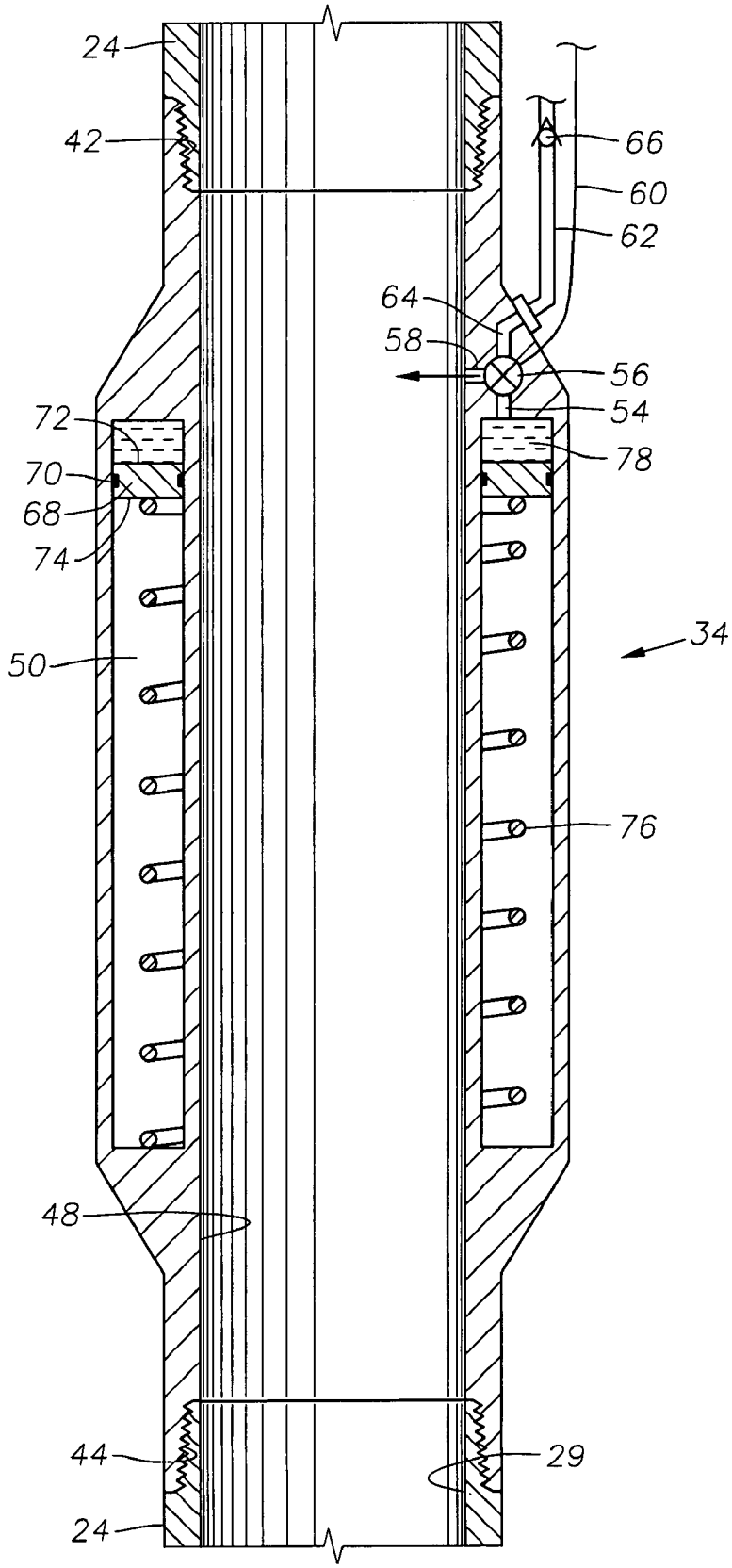
FIG. 3 is a side, cross-sectional view of the SSSV shown in FIG. 2, now after having been actuated to create a blockage within the production tubing string.

FIGS. 2 and 3 depict the SSSV 34 in greater detail. FIG. 2 depicts the SSSV 34 in an initial, unactuated position, while FIG. 3 shows the SSSV 34 after having been actuated to form a plug. The SSSV 34 includes a catalyst sub housing 40 having axial ends 42, 44 which are threaded so that they can be secured to other components in the production string 24. The housing 40 has an enlarged central portion 46 and defines an axial flow passage 48 within. Radially outside of the flow passage 48, an annular chamber 50 is defined within the central section 46. It is noted that, while the chamber 50 is shown and described herein to be an annular chamber, the chamber 50 may be of other suitable shapes or configurations. Examples of alternative chamber configurations include blind bore and radial. The direction of production fluid flow through the flow passage 48 is illustrated by the arrow 52. The upper end of the annular chamber 50 includes a fluid transmission port 54 that leads to a multi-positional flow control valve 56. A lateral flow passage 58 extends from the valve 56 to the flow passage 48. A valve control line 60 extends from the surface 14 to the flow control valve 56. The valve control line 60 is typically an electrical line, but might also comprise a hydraulic, optical fiber, or other control lines known in the art. The flow control valve 56 is preferably moveable between three positions. These positions include a first position wherein fluid communication from the chamber 50 through the port 54 is blocked by the valve 56 (i.e., the closed position); a second position wherein fluid from the chamber 50 may flow through the port 54, valve 56 and into the flow passage 48 via lateral flow passage 58 (i.e., the open position); and a third position wherein the valve 56 allows fluid to flow from a chamber refill conduit 62 through inlet 64 and into the flow passage 54 (i.e., the refill position). Those of skill in the art are familiar with multi-positional valves of this type and, therefore, its design will not be described further herein.

The chamber refill conduit 62 extends from the surface 14 and is interconnected with the flow control valve 56 via an inlet 64 that is formed into the housing 40. The refill conduit 62 may incorporate a one-way fluid flow check valve 66 that allows fluid to be flowed toward the valve 56 but not away from it. It is noted that the valve control line 60 is operationally associated with surface-based components, including, for example, a controller (not shown) for operating the valve 56. The refill conduit 62 is operationally associated with a pump and fluid reservoir (not shown) for providing a flow of fluid along the refill conduit 62. The structure and operation of devices of this nature are well understood and, therefore, are not described in any further detail herein.

An annular piston member 68 is disposed within the annular chamber 50. Fluid seals 70 ensure fluid-tight sealing between the piston member 68 and the surrounding surfaces of the chamber 50. The piston member 68 provides an upper axial side 72 and a lower axial side 74. A compression spring 76 is disposed within the chamber 50 below the piston member 68 and contacts the lower side 74 of the piston member 68, thereby biasing the piston member 68 upwardly within the chamber 50. A catalyst fluid 78 initially resides within the chamber 50 above the piston member 68.

The composition of the catalyst fluid 78 will vary depending upon the makeup of the fluid media that is flowing through the flowbore 29. In the instance of natural gas production, fresh water is a preferred catalyst fluid 78 as its addition to natural gas will result in the formation of solid hydrates. In the instance of a natural gas/fresh water combination, it is preferred to locate the plug formation sub 38 proximate a preferred hydrate formation depth, which is typically at or near the mud line in a wellbore.

In the instance of a wellbore wherein crude oil is primarily being produced through the flowbore 29, a currently preferred catalyst fluid 78 would be naturally-occurring paraffins. Other suitable viscosifiers or precipitants, which are capable of forming a substantially solid plug when mixed with crude oil may also be used.

In order to create a blockage within the flowbore 26, the flow control valve 56 is actuated from the closed position (FIG. 2) to the open position (FIG. 3). Catalyst fluid is allowed to escape from the chamber 50 under the impetus of the piston member 68 and spring 76. The catalyst fluid 78 in the chamber 50 is substantially exhausted into the flowbore 48 as the spring 76 urges the piston member 68 axially upwardly to the position illustrated in FIG. 3.

Figure 4:
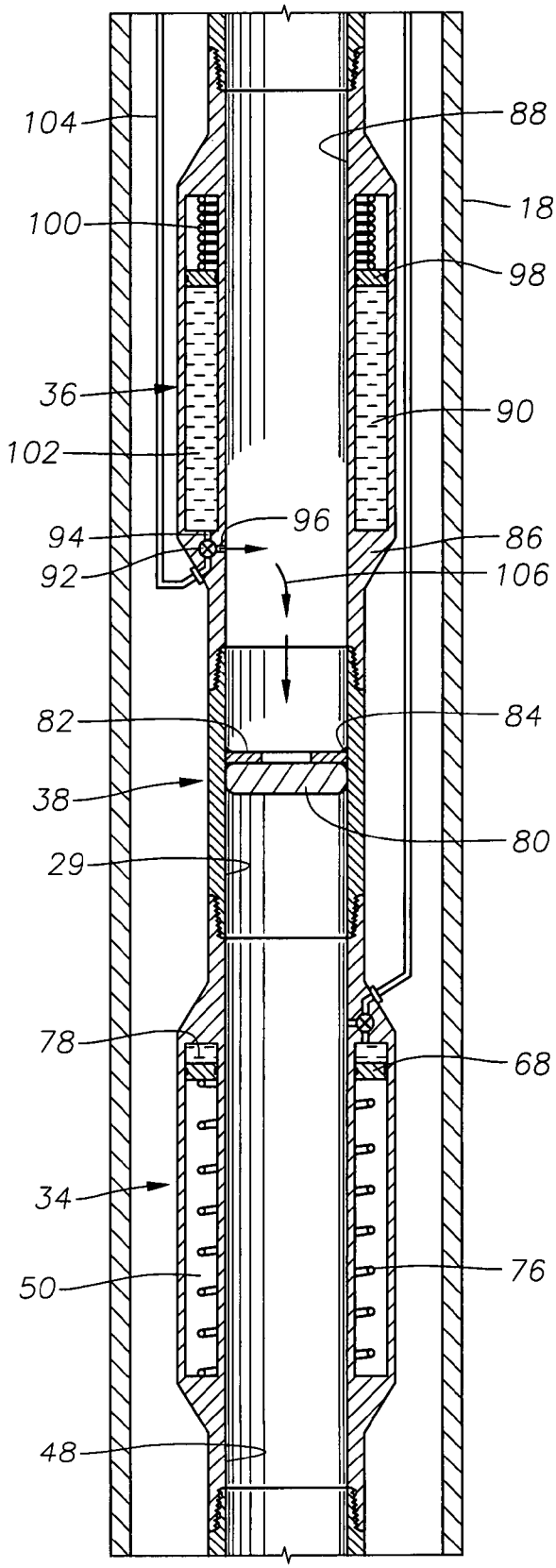
FIG. 4 is an enlarged view of portions of the production assembly illustrating a currently preferred location for development of a blockage as well as aspects of the blockage dissolving process.

Referring now to FIG. 4, aspects of the formation and subsequent dissolution of a blockage or plug within the flowbore 29 are further depicted. In FIG. 4, the catalyst fluid 78 from the chamber 50 of the SSSV 34 has been largely released into the flow passage 48 to mingle with the production fluid. A plug or blockage 80 will be formed within the plug formation sub 38. It is preferred that there be a flow restriction point formed within the plug formation sub 38 to promote the formation of the blockage 80. In the embodiment depicted in FIG. 4, the flow restriction point is formed by an orifice plate 82 held in position by welds 84. In alternative embodiments, the flow restriction could comprise a venturi tube apparatus or one or more fins that are located within the plug formation sub 38.

When it is desired to remove or dissolve plug 80, the reversing sub 36 is actuated. The reversing sub 36 is constructed in a manner similar to the SSSV 34. It includes a housing 86 with a central flow passage 88 and surrounding annular chamber 90. Preferably, the multi-position fluid control valve 92, fluid inlet 94, and lateral fluid outlet 96 are located at the lower end of the reversing sub 36 rather than at the upper end as with the SSSV 34. The piston member 98 and compression spring 100 are preferably located at the upper end of the chamber 90. The chamber 90 is filled with a plug dissolving agent 102. The reversing sub 36 is actuated by control line 104, by which the control valve 92 is moved to the open position to allow the plug dissolving agent 102 to be exhausted into the flowbore 29 by urging of the spring 100 against the piston member 98. The plug dissolving agent 102 will tend to settle downwardly onto the plug 80, as indicated by arrows 106, and reopen the flowbore 29 to fluid passage.

The composition of the plug dissolving agent 102 will vary in accordance with the nature of the production media being flowed through the flowbore 29 and the composition of the plug 80. In the instance of a natural gas producing well, which would be closed with a hydrate plug, preferred plug dissolving agents include glycol, methyl-ethyl-glycol (MEG), diesel, and other suitable solvents. In the instance of a crude oil producing well, a paraffin solvent, such as diesel can be used. Alternatively, a heated fluid may be used as the plug dissolving agent 102 in order to raise the temperature of the paraffin above its melting point, thereby dissolving it. The particular temperature of the heated fluid needed to dissolve the plug 80 will very depending upon the particular composition of the plug 80.

It is noted that the SSSV 34, reversing sub 36, and plug formation sub 38 collectively form an SSSV system wherein a plug may be formed and removed for selective blockage of the flowbore 29. It is also noted that mixtures of oil, gas and water may require that the catalyst fluid 78 be made up of a suitable mixture of the components of the fluids that are suitable for mixing with the complimentary components of the fluid media flowing through the flowbore 29. For example, if the media flowing through the flowbore 36 were a mixture of 30% natural gas and 70% crude oil, the catalyst fluid 78 could be made up of a mixture of about 30% fresh water and about 70% paraffin, for example. Similarly, where there is mixed fluid media, the plug dissolving agent 102 will also be made up of a suitable combination of fluid components for dissolution of the plug 80. In the example of 30% natural gas and 70% crude oil, the plug dissolving agent 102 might be composed of a combination of 30% glycol, MEG, or diesel and 70% paraffin solvent.

Those of skill in the art will recognize that numerous modifications and changes may be made to the exemplary designs and embodiments described herein and that the invention is limited only by the claims that follow and any equivalents thereof.

What is claimed is:

1. A subsurface safety valve for selectively closing a central axial flowbore of a production tubing string against fluid flow therethrough, comprising:

a housing that is incorporated within a production tubing string that is disposed within a wellbore casing and surrounded by an annulus within the wellbore casing, the housing defining a chamber containing a catalyst fluid that will combine with fluid media flowing through the central axial flowbore; and a mechanism for selectively flowing the catalyst fluid from the chamber to the flowbore to mix with the fluid media, the mixture of the catalyst fluid with the fluid media within the production tubing string flowbore forming a plug within the central axial flowbore.

2. The subsurface safety valve of claim 1 wherein the fluid media substantially comprises crude oil.

3. The subsurface safety valve of claim 1 wherein the fluid media substantially comprises natural gas.

4. The subsurface safety valve of claim 1 wherein the catalyst fluid substantially comprises fresh water.

5. The subsurface safety valve of claim 1 wherein the catalyst fluid is from the group consisting essentially of paraffin catalyst and asphaltene catalyst.

6. subsurface safety valve of claim 1 wherein the mechanism for selectively flowing the catalyst fluid comprises a flow control valve.

7. The subsurface safety valve of claim 6 wherein the mechanism for selectively flowing the catalyst fluid further comprises:

a piston member retained within the chamber; and a spring retained within the chamber to bias the piston member and urge the catalyst fluid out of the chamber.

8. The subsurface safety valve of claim 6 further comprising a refill conduit operably interconnected with the flow control valve for refilling the chamber.

9. A subsurface safety valve system for selectively blocking and unblocking an axial flowbore of a wellbore production tubing string, the system comprising:

a valve that is incorporated within the production tubing string and through which hydrocarbon production fluid is being flowed;

a catalyst portion of the valve having a chamber containing a catalyst fluid that will form a plug within the axial flowbore of the production tubing string; and a reversing portion of the valve having a chamber containing a plug dissolving agent that will substantially dissolve the plug from the flowbore.

10. The subsurface safety valve system of claim 9 further comprising a plug formation portion having a flow restriction to promote formation of the plug.

11. The subsurface safety valve system of claim 9 wherein the catalyst fluid substantially comprises fresh water.

12. The subsurface safety valve system of claim 9 wherein the catalyst fluid is from the group consisting essentially of paraffin catalyst and asphaltene catalyst.

13. The subsurface safety valve system of claim 9 wherein the plug dissolving agent substantially comprises at least one of the group consisting essentially of glycol, methyl-ethyl-glycol, and diesel.

14. The subsurface safety valve system of claim 9 wherein the plug dissolving agent substantially comprises a paraffin solvent.

15. The subsurface safety valve system of claim 9 wherein the plug dissolving agent substantially comprises a heated fluid.

16. The subsurface safety valve system of claim 9 wherein the catalyst portion further comprises:

a flow control valve for selectively releasing catalyst fluid from the chamber to the flowbore;

a piston member disposed within the chamber; and a spring retained within the chamber to bias the piston member and urge catalyst fluid out of the chamber.

17. A method of selectively closing off fluid flow within an axial flowbore of a wellbore production tubing string comprising the steps of:

flowing a hydrocarbon production fluid from a subterranean formation into a production tubing string that is disposed within a wellbore;

flowing the production fluid upwardly through the production tubing string;

as the hydrocarbon production fluid is being flowed, releasing a catalyst fluid into the axial flowbore of the production tubing string; and allowing the catalyst fluid to react with production fluid flowing within the flowbore to form a substantially solid plug within the flowbore.

18. The method of claim 17 further comprising the step of releasing a plug dissolving agent into the flowbore to substantially dissolve the plug.

19. The method of claim 17 wherein the step of releasing the catalyst fluid into the flowbore comprises operating a flow control valve to allow fluid communication between a chamber, containing the catalyst, and the flowbore.

20. The method of claim 19 wherein the step of releasing catalyst fluid into the flowbore further comprises urging a piston member against the catalyst in the chamber to flow the catalyst into the flowbore.

* * * * *

UNITED STATES PATENT AND TRADEMARK OFFICE

CERTIFICATE OF CORRECTION

PATENT NO. : 7,493,956 B2
APPLICATION NO. : 11/376940
DATED : February 24, 2009
INVENTOR(S) : Shaw et al.

It is certified that error appears in the above-identified patent and that said Letters Patent is hereby corrected as shown below:

At Column 5, line 12, the text reading "6. subsurface safety" should read --6. The subsurface safety--.

Signed and Sealed this

Twenty-first Day of April, 2009

JOHN DOLL
*Acting Director of the United States Patent and Trademark Office*